US009028043B2

(12) United States Patent
Bradway et al.

(10) Patent No.: US 9,028,043 B2
(45) Date of Patent: May 12, 2015

(54) PRINTHEAD DRIP MANAGEMENT USING INDEXING CLEANING WEB-BACKED FLEXURE CHUTE

(71) Applicant: Xerox Corporation, Norwalk, CT (US)

(72) Inventors: Jeffrey John Bradway, Rochester, NY (US); Matthew D. Savoy, Webster, NY (US); Frank Berkelys Tamarez Gomez, Rochester, NY (US); Jorge M. Rodriquez, Webster, NY (US); Jeffrey Swing, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1 day.

(21) Appl. No.: 14/014,934

(22) Filed: Aug. 30, 2013

(65) Prior Publication Data

US 2015/0062241 A1 Mar. 5, 2015

(51) Int. Cl.
*B41J 2/165* (2006.01)
*B41J 2/185* (2006.01)

(52) U.S. Cl.
CPC ..... *B41J 2/16535* (2013.01); *B41J 2/16517* (2013.01); *B41J 2/16547* (2013.01); *B41J 2/185* (2013.01); *B41J 2/16523* (2013.01)

(58) Field of Classification Search
CPC .. B41J 2/16547; B41J 2/16538; B41J 2/1652; B41J 2/16523; B41J 2/16517; B41J 2/16505; B41J 2/1707; B41J 2/1714
USPC ..... 347/22, 24, 28, 29, 31–33, 35–36
See application file for complete search history.

(56) References Cited

U.S. PATENT DOCUMENTS

| | | | | |
|---|---|---|---|---|
| 6,017,110 | A | 1/2000 | Jackson | |
| 6,644,775 | B2 | 11/2003 | Murcia et al. | |
| 8,783,827 | B2 * | 7/2014 | Hirabayashi | 347/36 |
| 2009/0102906 | A1 | 4/2009 | Phillips et al. | |
| 2010/0238227 | A1 | 9/2010 | Nystrom et al. | |

* cited by examiner

*Primary Examiner* — Juanita D Jackson
(74) *Attorney, Agent, or Firm* — Maginot Moore & Beck LLP

(57) ABSTRACT

A printhead cleaning device is configured to use a cleaning web to absorb the residual ink left on the faceplate of the printhead. The cleaning web is supplied from a feed cartridge and taken up by a take-up cartridge. The cartridges include indexing mechanisms that are configured to dispense and pull-in, respectively, a predetermined length of the cleaning web during each maintenance cycle of the printhead.

17 Claims, 4 Drawing Sheets

PRINTHEAD DRIP MANAGEMENT USING INDEXING CLEANING WEB-BACKED FLEXURE CHUTE

TECHNICAL FIELD

This disclosure relates generally to inkjet printers that eject ink to form ink images on print media, and, more particularly, to devices that clean ink from printheads in such printers.

BACKGROUND

In general, inkjet printers include at least one printhead that ejects drops of liquid ink onto recording media or a surface of an image receiving member. In an indirect or offset printer, the inkjets eject ink onto the surface of the image receiving member, such as a rotating metal drum or endless belt, and then the image is transferred to print media. In a direct printer, the inkjets eject ink directly onto the media, which may be in sheet or continuous web form. A phase change inkjet printer employs phase change inks that are solid at ambient temperature, but transition to a liquid phase at an elevated temperature. Once the melted ink is ejected onto the media or image receiving member, depending upon the type of printer, the ink droplets quickly solidify to form an ink image.

Printers typically conduct various maintenance operations to ensure proper operation of the inkjets in each printhead. One known maintenance operation removes particles or other contaminants that may interfere with printing operations from each printhead in a printer. During such a cleaning maintenance operation, a pneumatic fluid, such as air, is forced into the printheads to purge ink through some or all of the inkjets in the printhead. The purged ink flows from the apertures of the inkjets that are located in a faceplate of each printhead onto the faceplate of each printhead. The ink flows downwardly under the effect of gravity to an ink drip bib mounted at the lower edge of the faceplate. The bib is configured with one or more multiple drip points where the liquid ink collects and drips into an ink receptacle. One or more wipers are manipulated to contact the faceplate of each printhead and wipe the purged ink toward the drip bib to facilitate the collection and removal of the purged ink.

Some printers have been equipped with a flexure chute that is moved into contact with the faceplate below the apertures during a cleaning operation. The chute is used to deflect purged and/or wiped ink away from the faceplate and into a catch tray. While this system sufficiently removes ink from the aperture area of the faceplate, a line of ink (i.e., witness line) may remain on the faceplate surface of the printhead where the flexure chute contacts the faceplate. This witness line of residual ink accumulates further with time and repeated maintenance cycles. Eventually, the accumulated ink can run down the drip bib surface and coalesce at the drip points or be forced onto the aperture area of the faceplate by airflow caused by print media moving past the printhead. Accumulated ink at the drip points may eventually freeze and fall into the paper path where it can impact print quality and potentially cause damage to printheads. Thus, improved systems and methods for preventing the accumulation of purged ink on the faceplates of printheads are desirable.

SUMMARY

To address difficulties associated with residual ink contamination on the printhead faceplate and drip bib, a printhead cleaning device is provided that includes a flexure chute having a first end and a second end, and an ink receptacle in which the second end of the flexure chute is positioned to enable ink to flow from the first end of the flexure chute along one side of the flexure chute into the ink receptacle. The cleaning device includes a length of absorbent material positioned near the first end of the flexure chute with the length of the absorbent material being approximately a same distance as a width across the printhead array.

In another embodiment, a method of operating a cleaning device of an inkjet printer includes pressing a first end of a flexure chute of a cleaning device against a faceplate of a printhead at a first position, the flexure chute including a second end positioned over an ink receptacle. A length of absorbent material of the cleaning device is then pressed against the faceplate at a second position which is below the first end of the flexure chute with the length of absorbent material being approximately a same distance as a width across the printhead array.

DETAILED DESCRIPTION

Figure 1:
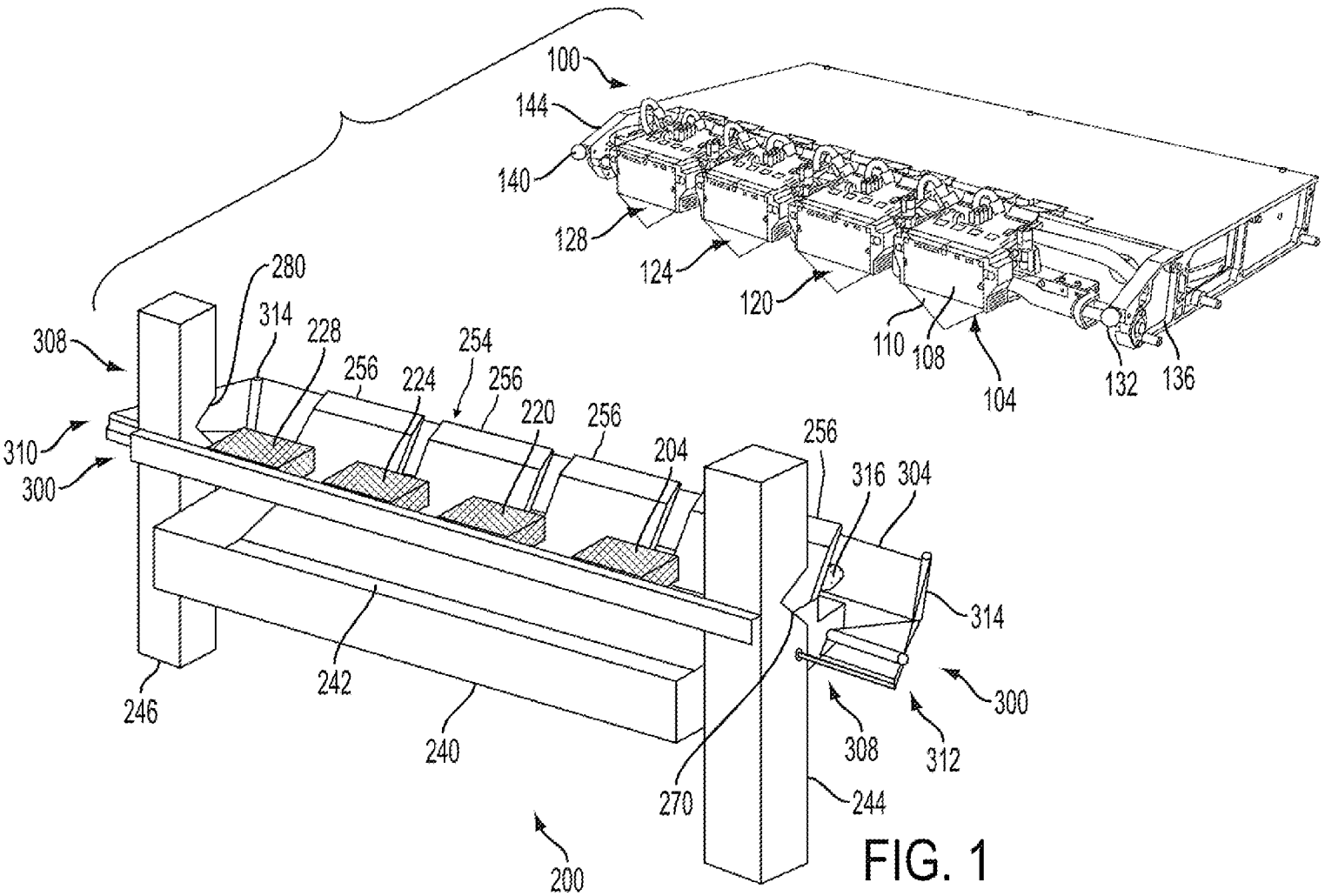
FIG. 1 is a partially exploded view of a printhead array and a cleaning unit including a cleaning web system.

For a general understanding of the present embodiments, reference is made to the drawings. In the drawings, like reference numerals have been used throughout to designate like elements. As used herein, the terms "printer" generally refer to an apparatus that applies an ink image to print media and may encompass any apparatus, such as a digital copier, bookmaking machine, facsimile machine, multi-function machine, etc. which performs a printing function for any purpose.

As used in this document, "ink" refers to a colorant that is liquid when applied to an image receiving member. For example, ink may be aqueous ink, ink emulsions, solvent based inks and melted phase change inks. Phase changes inks are inks that are in a solid or gelatinous state at room temperature and change to a liquid state when heated to a melting temperature. The melted ink can then be applied or ejected onto an image receiving member. The phase change inks return to a solid or gelatinous state when cooled on print media after the printing process. "Print media" can be a physical sheet of paper, plastic, or other suitable physical substrate suitable for receiving ink images, whether precut or web fed.

As used herein, the term "direct printer" refers to a printer that ejects ink drops directly onto a print medium to form the ink images. As used herein, the term "indirect printer" refers to a printer having an intermediate image receiving member, such as a rotating drum or endless belt, which receives ink drops that form an ink image. In the indirect printer, the ink image is transferred from the indirect member to a print medium via a "transfix" operation that is well known in the art. A printer may include a variety of other components, such as finishers, paper feeders, and the like, and may be embodied as a copier, printer, or a multifunction machine. Image data corresponding to an ink image generally may include information in electronic form, which is to be rendered on print media by a marking engine and may include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member. As used herein, the term "process direction" refers to the direction in which the substrate onto which the image is transferred moves past the printheads for formation of an ink image. The term "cross-process direction" refers to a direction, along the same plane as the substrate, which is substantially perpendicular to the process direction.

FIG. 1 depicts a printhead array 100 and a cleaning unit 200. Printhead array 100 includes printhead units 104, 120, 124, and 128, docking balls 132 and 140, and printhead array carriage members 136 and 144. Each printhead unit includes a printhead face, with printhead unit 104 shown having a front faceplate 108 with a drip bib 110. The printhead faceplate 108 includes an array of apertures to which inkjets are fluidly coupled for the ejection of ink drops onto an image receiving surface. A printer may include one or more printhead arrays, such as printhead array 100, which are configured to eject ink having one or more colors onto the image receiving surface.

Cleaning unit 200 includes a housing, shown here as support rails 244 and 246 and ink receptacle 240, a flexure chute assembly 254, a cleaning web system 300, and printhead wiper units 204, 220, 224, and 228. Support rails 244 and 246 maintain ink receptacle 240 in place and support the wiper units 204, 220, 224, and 228. Ink receptacle 240 is a container that forms a volume with a sufficient size to hold ink purged from each of the printheads 104, 120, 124, and 128 in printhead array 100 during cleaning operations. The top 242 of the ink receptacle 240 is open to enable ink purged from printheads in the printhead array 100 to flow into the ink receptacle 240. While cleaning unit 200 includes a single ink receptacle 240, alternative cleaning unit embodiments can employ two or more receptacles. Rails 244 and 246 include docking members 270 and 280, respectively. The docking members 270 and 280 are configured to engage docking balls 132 and 140, respectively, on the printhead array 100 to secure the printhead array 100 to the cleaning unit 200 during purge and cleaning operations.

In the embodiment of FIG. 1, the printhead array 100 is configured to engage the cleaning unit 200 for cleaning operations. Carriage members 136 and 144 guide the printhead array 100 to the cleaning unit 200, where docking balls 132 and 140 engage docking members 270 and 280, respectively Each docking ball is configured to slide into a fully engaged position with the corresponding docking member in the cleaning unit. Wiper units 204, 220, 224, and 228 are secured to the support rails 244 and 246 and are positioned to wipe the faces of printheads 104, 120, 124, and 128, respectively, when the printhead array 100 is engaged to the cleaning unit 200. Typical docking members include triangular or conically shaped indentations formed in support members that are arranged along either side of an ink receptacle or an image receiving surface. While support rails 244 and 246 and ink receptacle 240 form the housing for the cleaning unit 200, the housing may be any suitable structure that secures the cleaning unit components and enables the components of the cleaning unit to remove purged ink from the printheads of a printhead array.

The ink receptacle 240 is configured to receive ink from printhead array 100 through the open top 242. The flexure chute assembly 254 includes a flexure chute 256 for each printhead unit 104, 120, 124, 128 in the printhead array 100. The flexure chute assembly 254 extends through the housing opening 242 to enable each flexure chute 256 to contact the face 108 of the corresponding printhead unit. Each flexure chute 256 has a width that is sufficient to extend across the face of the printhead unit as the printhead array 100 engages and disengages with the cleaning unit 200. The flexure chutes 256 of the illustrated embodiment comprise rectangular plates, although any shape and size capable of capturing ink purged from the printheads may be used. The flexure chutes 256 can be formed of stainless steel or any other material suitable to direct ink from a printhead to an ink receptacle.

Figure 2:
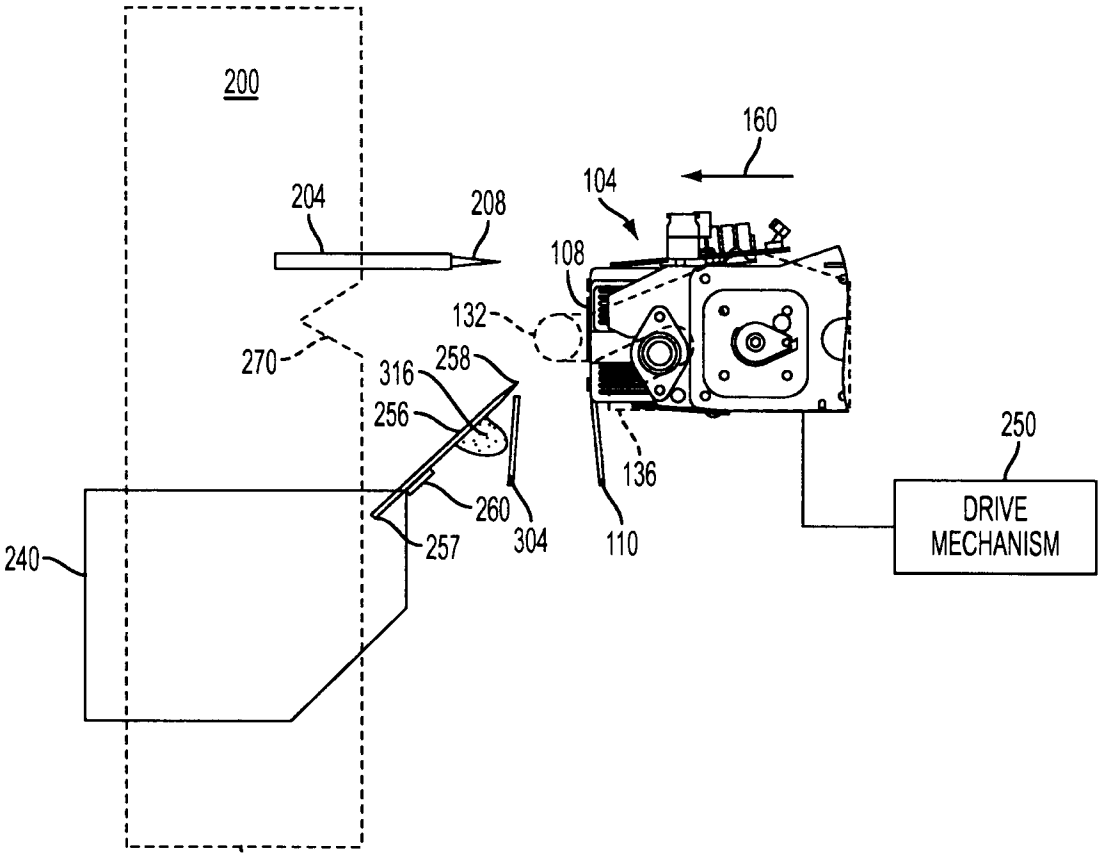
FIG. 2 is a side view of a printhead disengaged from a cleaning unit.

FIG. 2 depicts a side view of a printhead unit 104 in a position prior to engaging the printhead unit 104 with the cleaning unit 200 and ink receptacle 240 for printhead cleaning. The ink receptacle 240 includes the flexure chute 256. During operation, the flexure chutes 256 is heated by the printhead which helps to maintain the phase change ink in a liquid state so it will flow into the ink receptacle 240. In alternative embodiments, the ink receptacle may include a heater, such as heater 260 depicted in FIGS. 2-4. The heater 260 is an electrical heater mounted to the member 256 to heat the member during printhead cleaning operations. The cleaning unit 200 includes a docking member 270 in the housing guide rail 244 positioned on one side of ink receptacle 240, as well as a wiper 204, which includes a wiper blade 208. Printhead unit 104 includes a printhead face 108 and is shown held in position by a carriage member 136. Printhead unit 104 may be one printhead in an array of printheads as depicted in FIG. 1. Carriage member 136 and docking ball 132 are configured to guide printhead unit 104 to engage with docking member 270.

In the configuration of FIG. 2, a drive mechanism 250 is operatively connected to the carriage member 136, docking ball 132, and printhead unit 104. Typical embodiments for drive mechanism 250 include electric motors coupled to the printhead array using gears or pulleys, hydraulic and pneumatic actuators, or any other mechanism configured to reposition printheads in the printer. The drive mechanism 250 moves the docking ball 132, carriage 136, and printhead unit 104 towards the ink receptacle 240 in direction 160 until the docking ball 132 couples with the docking member 270 and the flexure chute 256 engages the printhead faceplate 108.

Figure 3:
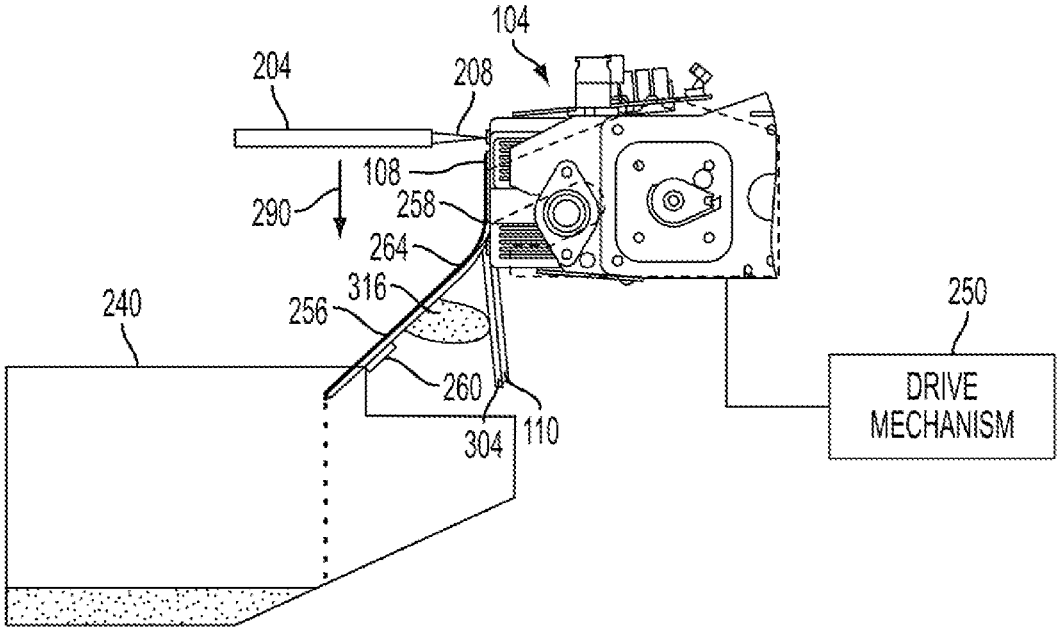
FIG. 3 is a side view of a printhead engaged to a cleaning unit prior to wiping.

The flexure chute 256 has a first end 257 and a second end 258. The first end 257 is located at a position inside the ink receptacle 240 that enables gravity to pull ink from the second end 258 of the flexure chute 256 into the ink receptacle 240. The second end 258 of the flexure chute 256 is configured to engage the printhead faceplate 108 during cleaning and maintenance in order to collect ink emitted from the apertures onto the faceplate during a purge process. FIG. 3 shows the faceplate 108 of the printhead 104 engaged with the flexure chute 256 and wiper blade 208 during a purge process. When the flexure chute 256 comes into contact with the faceplate 108 of the printhead 104, the flexure chute 256 flexes. Deformation of the flexure chute 256 helps the second end of the flexure chute to form a seal with the faceplate of the printhead 104.

During purge operations, the receptacle 240 is positioned close enough to the faceplate 108 to enable the second end 258 of the chute 256 to contact the faceplate 108 at a position below the apertures in the faceplate, but above the juncture between the drip bib 110 and the faceplate 108. Pressure applied to the reservoir within the printhead urges ink 264 through the inkjets to the apertures in the faceplate 108. This pressure does not eject the ink, but rather releases ink onto the faceplate 108. This action helps unclog the inkjets, dissolve debris or solidified ink on the faceplate, and act as a lubricant for the wiper. Once the purged ink 264 flows down the printhead face 108 to the juncture with the second end 258 of the flexure chute 256, the flexure chute 256 guides the ink 264 into the ink receptacle 240.

Figure 4:
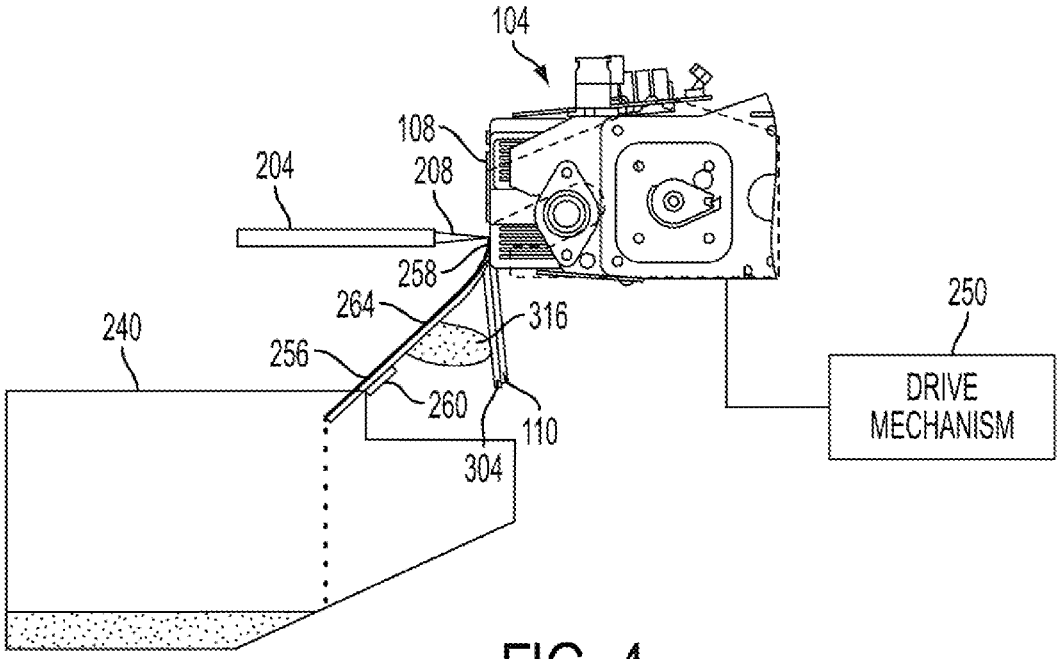
FIG. 4 is a side view of a printhead engaged to a cleaning unit after wiping.

Wiper 204 and wiper blade 208 are also moved into contact with the faceplate 108 above the apertures for the inkjets and swiped downwardly in direction 290 to direct any ink 264 remaining on the printhead face 108 onto the flexure chute 256 and into the ink receptacle 240. FIG. 4 shows the printhead 104 engaged with the flexure chute 256 and wiper blade 208 at the end of a wiping operation. The wiper 204 and wiper blade 208 are shown at the junction of the second end 258 of the flexure chute 256 with the bottom part of the printhead face 108. The wiper blade 208 is in contact with the second end 258 of the flexure chute 256 to help ensure that the ink 264 has been removed from the faceplate 108 and directed onto the flexure chute 256 for collection in the receptacle 240.

In accordance with the present disclosure, a cleaning web system 300 is incorporated into the cleaning unit 200 for removing purged ink that can accumulate on the faceplate 108 at a position where the faceplate 108 is contacted by the flexure chute 256. Referring to FIGS. 1-4, the cleaning web system 300 uses a web, or strip, of an absorbent material, referred to herein as a cleaning web 304, to absorb the purged ink left on the faceplate 108. The cleaning web 304 is formed of any material that is compatible with the ink used in the printhead and is capable of absorbing the purged ink from the faceplate without contaminating the faceplate, e.g., with fibers and dust from the web.

The cleaning web system 300 includes a cleaning web support assembly 308 that is configured to support the cleaning web 304 with the web extended across the printhead unit (in the cross-process direction) between the lower portion of the face plate and drip bib of the printhead and the flexure chute of the cleaning station. The cleaning web 304 is supplied from a feed cartridge 310 that is supported by the support rail 246 of the cleaning unit 200. A take-up cartridge 312 is supported by the support rail 244 at the other end of the cleaning unit 200 for taking up and storing the cleaning web 304 pulled from the feed cartridge 310.

The support assembly 308 may include various structures for defining the position, orientation, and path of movement of the cleaning web 304 in relation to the faceplate 108 and the flexure chute 256. For example, in the embodiment of FIG. 1, the feed cartridge 310 and take-up cartridge 312 are supported with the axis of rotation of the rolls oriented horizontally and substantially parallel to the faceplates 108. Between the feed cartridge 310 and take-up cartridge 312, the cleaning web 304 is wound onto redirection rolls 314 that are used to control the orientation and positioning of the cleaning web 304 in relation to the faceplates 108 and the flexure chute 256. As can be seen in FIG. 1, the redirection rolls 314 change the orientation of the cleaning web 304 from horizontal to nearly vertical.

In the embodiment of FIGS. 3 and 4, the printhead unit 104 is shown in a docked position with the end 258 of the flexure plate 256 contacting the faceplate 108. The cleaning web 304 is supported with an upper edge of the web 304 positioned adjacent to the leading end or tip 258 of the flexure chute 256 so that the web 304 contacts the faceplate 108 at or near the juncture of the end 258 of the flexure plate 256 with the faceplate 108. In this embodiment, the cleaning web 304 has a width from the upper edge to the lower edge of the web that enables the cleaning web 304 to extend over substantially the entire drip bib 110. After the purging and ink collection operation, the printhead array undocks from the cleaning unit 200. As the printhead array undocks, the printheads move down relative to the flexure chute 256 and cleaning web 304. Before the printhead 104 shown in FIG. 3 and FIG. 4 has fully finished undocking from the cleaning unit 200, the printhead 104 moves out of contact with the flexure chute 256 while the cleaning web 304 remains in contact with the faceplate to absorb the purged ink at the witness line. As can be seen in FIG. 3, the ink receptacle 240 may be configured to extend beyond the tip of the drip bib 110.

In one embodiment, the witness mark cleaning system includes a pressing member 316 for pressing the cleaning web 304 against the face plate 108 and the drip bib 110 to facilitate the absorption of purged ink. The pressing member 316 can comprise a pliable structure, such as a foam spacer, that is supported on the side of the flexure chute opposite the side on which purged ink flows into the receptacle 240. The pressing member 316 is positioned to urge the cleaning web 304 against the drip bib 110 when the flexure chute 256 is at or near the faceplate 108. In some embodiments, the pressing member 316 is used alone to absorb purged ink from the faceplate without a cleaning web 304 being provided.

Figure 5:
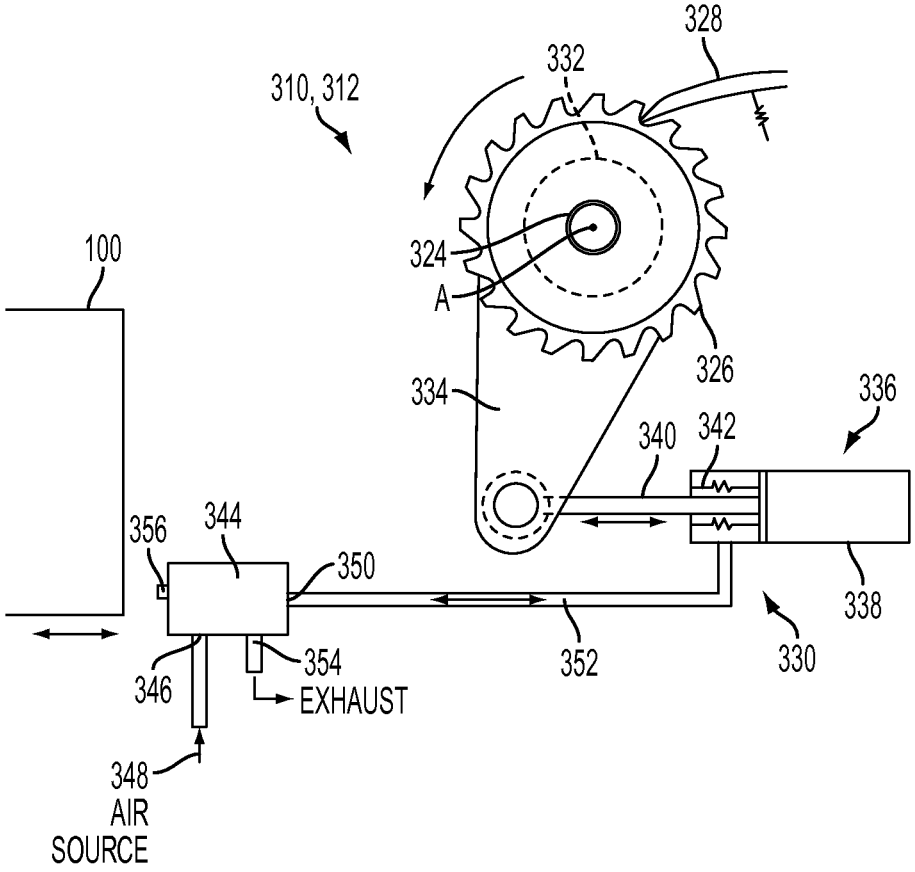
FIG. 5 is schematic view of an indexing drive mechanism for the cleaning web system.

The feed and take-up cartridges 310, 312 of the cleaning web system 300 each include an indexing drive mechanism that enables a predetermined length of the cleaning web 304 to be unwound by the feed cartridge 310 and taken up by the take-up cartridge 312 for each docking cycle between the printhead array 100 and the cleaning unit 200. An embodiment of a cartridge having an indexing drive system for implementing the feed and take-up cartridges 310, 312 is depicted in FIG. 5.

The cartridge 310, 312 includes a housing (not shown) for supporting a mandrel 324, a ratchet wheel 326, a ratchet pawl 328, and a drive mechanism 330, so the components can be installed and removed from the cleaning station of the printer as a unit. The mandrel 324 comprises a rotatable member, such as a tube or shaft, upon which the cleaning web is wound or from which the cleaning web is unwound depending upon whether the cartridge is a feed or take-up cartridge. The mandrel 324 is supported in the cartridge for rotation about an axis A. A ratchet wheel 326 is fixedly attached to at least one end of the mandrel 324 for rotation with the mandrel 324 about the axis A. The ratchet pawl 328 is mounted in position to interact with the ratchet wheel 326. The ratchet wheel 326 and ratchet pawl 328 are configured to interact to enable rotation of the mandrel 324 about the axis A in a first direction and to prevent rotation of the mandrel 324 about the axis A in the opposite direction.

The indexing drive mechanism 330 is operably connected to the mandrel 324 for rotating the mandrel 324 in the first direction in predetermined angular increments. In one embodiment, the indexing drive mechanism includes a one-way clutch 332, a link arm 334, and an actuator 336. The clutch 332 is shown in phantom since it is located behind the ratchet wheel 326. One end of the link arm 334 is supported for rotation about the axis A of the mandrel 324 while the other end of the link arm 334 is attached to the actuator 336. The one-way clutch 332 connects the mandrel 324 to the link arm 334 when the link arm 334 is pivoted about the axis in the first direction and disconnects the mandrel 324 from the link arm 334 when the link arm 334 is pivoted about the axis A in the opposite direction.

When the link arm 334 is pivoted about the axis A in the first direction, the mandrel 324 is locked to the link arm 334 and is rotated about the axis A in the first direction along with the link arm. Rotational movement of the mandrel 324 in the first direction may be used to let out a length of the cleaning web 304 in the case of the feed cartridge 310 and may be used to take up a length of the cleaning web in the case of the take-up cartridge 312. An actuator 336 is configured to pivot the link arm 334 about the axis A between a first angular position and a second angular position. The distance between the first and second positions of the link arm 334 controls the length of cleaning web that is let out by the feed cartridge 310 and taken up by the take-up cartridge 312 when the link arm 334 is cycled from the first position to the second position.

Movement of the link arm 334 from the first to the second position causes the mandrel 324 to be indexed from one angular incremental position to the next angular incremental position. When the link arm 334 is pivoted from the second position to the first position, the mandrel 324 is disconnected from the link arm 334 by the one-way clutch 332 and is allowed to rotate with respect to the link arm 334. Backward rotation of the mandrel 324 is prevented by interaction between the ratchet wheel 326 and the ratchet pawl 328. As a result, the mandrel 324 is retained at the angular position reached the last time the link arm 334 was cycled from the first position to the second position.

In one embodiment, the indexing drive mechanism 330 is configured for pneumatic actuation. The cleaning unit 200 of the printer already has a pneumatic system in place for use in maintenance operations, such as wiper actuation and/or purging operations. This system can be adapted in a simple manner for use actuating the indexing drive mechanism. An embodiment of a pneumatic actuator for the indexing drive mechanism of a cartridge is depicted in FIG. 5. The pneumatic actuator of FIG. 5 includes a pneumatic cylinder 338 that is fluidly coupled to a source of pressurized fluid, such as air, via a system of fluid lines and valves. A piston 340 is translatably supported in the cylinder 338 for movement between an extended position and a retracted position. The piston 340 is biased into the extended position by a biasing member, such as one or more springs 342.

The piston 340 is configured to be moved to the retracted position in response to pressurized fluid being delivered into the cylinder 338. The piston 340 is returned to the extended position by the biasing member 342 when pressurized fluid is discharged from the cylinder 338. The outer end of the piston is attached to the link arm 334. When the piston 340 is retracted into the cylinder 338, the piston 340 pulls the link arm 334 from the first position to the second position. When the piston 340 is extended from the cylinder 338, the piston 340 pushes the link arm 334 from the second position to the first position.

In the embodiment of FIG. 5, a pneumatic valve 344 is used to control the flow of fluid into and out of the pneumatic cylinder. The pneumatic valve 344 has an inlet 346 that is connected to a supply 348 of pressurized fluid and an outlet 350 that is connected to the cylinder 338 via a fluid line 352. The pneumatic valve 344 also has an exhaust outlet 354. When the pneumatic valve 344 is in an open position, the fluid inlet 346 is connected to the fluid outlet 350 so that pressurized fluid is supplied to the pneumatic cylinder 338. When the pneumatic valve 344 is in a closed position, the fluid outlet 350 to the pneumatic cylinder 338 is connected to the exhaust outlet 354 so that the pressurized fluid from the cylinder 336 can be released.

The pneumatic valve 344 is operated by a switch 356, such as a microswitch, that is configured to control the position of the pneumatic valve. The switch 356 can control the valve position in any suitable manner. In one embodiment, the switch 356 is configured to move the pneumatic valve 344 to the open position in response to the printhead array 100 being docked. For example, the switch 356 may be placed in a position where it can be activated, e.g., depressed, by a portion of the housing or casing of the printhead array 100 once the printhead array 100 has been docked with the cleaning unit 200.

When the switch 356 is depressed, the pneumatic valve 344 is opened and fluid is delivered to the pneumatic cylinder 336. During operation of the web cleaning system 300, the pressurized fluid is supplied to the pneumatic cylinders of the feed cartridge 310 and the take-up cartridge 312. The supply of pressurized fluid to the cylinders 338 causes the pistons 340 in the cylinders to be moved from extended positions to retracted positions. The pistons in turn pull the respective link arms 334 from the first position to the second position.

In the feed cartridge, movement of the link arm 334 from the first position to the second position causes the associated mandrel 324 to rotate from one incremental angular position to the next incremental angular position and let out a predetermined length of the cleaning web 304. In the take-up cartridge, movement of the link arm 334 from the first position to the second position causes the associated mandrel 324 to rotate from one incremental angular position to the next incremental angular position and take up the same predetermined length of the cleaning web. When the printhead array 100 is undocked from the cleaning unit 200, the switch 356 is deactivated and the pneumatic valve 344 returns to the closed position. As a result, the fluid under pressure in the cylinder 338 escapes via the exhaust outlet 354 of the valve 344 and the link arm 334 returns to the first position.

The length of the web that is dispensed and taken up during each cycle of the link arm depends on a number of factors, such as the diameter of the mandrel and configuration of the link arm. Any suitable sizing and dimensioning of these components may be used to enable a suitable length of cleaning web to be wound and unwound during each cycle of the link arm. Although the link arm 334 is depicted as a simple lever in FIG. 5, the link arm 334 can be provided in a variety of different configurations and may include gearing and other mechanisms to facilitate a desired amount of rotation of the mandrel during each cycle of the link arm.

In one embodiment, the drive mechanism is configured to actuate the link arm 334 to rotate the mandrel a single time when the switch 356 is activated during a docking sequence of the printhead array 100. In alternative embodiments, the drive mechanism may be configured to actuate the link arm multiple times when the switch is activated in order to wind or unwind a desired length of the web. Any suitable method or system may be used to enable the link arm to be cycled multiple times during a docking sequence. For example, pneumatic control components and valving may be used to cycle the link arm multiple times by periodically evacuating the cylinder. Although the drip management system described above can be incorporated into a printer without having to add additional electrical or control dependencies, electronic control mechanisms, such as electronic valves and/or timers, may be used to enable the link arm to be cycled as well as to synchronize the cycling of the link arms in both the feed and take-up cartridges if desired.

In addition, in some alternative embodiments, other types of switches and/or sensors may be used to actuate the indexing mechanism based on the position of the printhead array or the position and/or operational state of other components of the printer. In addition, although pneumatic actuation has been described for use in the indexing drive mechanism, other forms of actuation can be used in alternative embodiments, such as electrical and electromechanical actuation. For example, an electromechanical solenoid can be used to control the movement of the link arm in conjunction with the appropriate electric switches, controls, processors, and/or software components.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printhead cleaning device for use in an inkjet printer comprising:

a flexure chute having a first end and a second end;

an ink receptacle in which the second end of the flexure chute is positioned to enable ink to flow from the first end of the flexure chute along one side of the flexure chute into the ink receptacle;

a length of absorbent material positioned near the first end of the flexure chute, the length of the absorbent material being approximately a same distance as a width across the printhead array;

a first rotatable member about which a portion of the absorbent material is wound;

a second rotatable member about which another portion of the absorbent material is wound;

at least one actuator operatively connected to the first rotatable member and the second rotatable member; and a switch operatively connected to the at least one actuator, the switch being configured to activate the at least one actuator to unwind a second length of the absorbent material from the first rotatable member and to wind the length of the absorbent material onto the second rotatable member.

2. The printhead cleaning device of claim 1, wherein the switch is configured to activate the at least one actuator for each maintenance cycle of a printhead associated with the cleaning device.

3. The printhead cleaning device of claim 1 further comprising:

a first indexing drive mechanism operatively connected to the at least one actuator and the first rotatable member; and a second indexing drive mechanism operatively connected to the at least one actuator and the second rotatable member.

4. The printhead cleaning device of claim 3, each indexing drive mechanism further comprising:

a link arm connected to the rotatable member in the mechanism and to the at least one actuator to enable the actuator to move the link arm in a first direction and in a second direction opposite the first direction; and a one-way clutch interposed between the link arm and the rotatable member in the mechanism to enable the link arm to move the rotatable member in the first direction in response to the actuator moving the link arm in the first direction and to disconnect the rotatable member from the link arm in response to the actuator moving in the second direction.

5. The printhead cleaning device of claim 4, each indexing drive mechanism further comprising:

a ratchet wheel in each indexing drive mechanism that is attached to the rotatable member in the indexing drive mechanism; and a ratchet pawl in each indexing drive mechanism that is positioned to interact with the ratchet wheel in the indexing drive mechanism to prevent rotation of the rotatable member in the indexing drive mechanism in the second direction.

6. The printhead cleaning device of claim 1 further comprising:

a member mounted to another side of the flexure chute that is opposite the side along which the ink flows into the ink receptacle, the member being configured to urge the web towards the first end of the flexure chute.

7. The printhead cleaning device of claim 6, the member further comprising:

a compressible foam.

8. The printhead cleaning device of claim 1, the at least one actuator further comprising:

a pneumatic actuator.

9. A method of operating a cleaning device of an inkjet printer, the method comprising:

pressing a first end of a flexure chute of a cleaning device against a faceplate of a printhead at a first position, the flexure chute including a second end positioned over an ink receptacle; and pressing a length of absorbent material of the cleaning device against the faceplate at a second position which is below the first end of the flexure chute, the length of absorbent material being approximately a same distance as a width across the printhead array.

10. The method of claim 9, further comprising:

moving at least one of the first end of the flexure chute and the printhead until the first end of the flexure chute is spaced apart from the faceplate while maintaining the length of absorbent material in contact with the faceplate;

after the flexure chute is spaced apart from the faceplate, moving at least one of the length of absorbent material and the printhead until the length of absorbent material contacts the first position on the faceplate of the printhead; and after the length of absorbent material contacts the first position on faceplate of the printhead, moving at least one of the length of absorbent material and the printhead until the length of absorbent material is spaced apart from the printhead.

11. The method of claim 9, further comprising:

unwinding a second length of the absorbent material from a first rotatable member positioned near one side of the printhead array; and winding the length of the absorbent material onto a second rotatable member positioned near an opposite side of the printhead array in response to the printhead and the cleaning device being in a docked position in relation to each other.

12. The method of claim 11, wherein the unwinding of the second length of the absorbent material and the winding of the length of absorbent material is performed using an indexing drive mechanism.

13. The method of claim 12, wherein the indexing drive mechanism is pneumatically actuated.

14. The method of claim 9, further comprising:

wiping the faceplate downwardly using a wiper blade.

15. The method of claim 10, further comprising:

pressing the length of absorbent material against the faceplate using a pressing member.

16. The method of claim 15, the pressing member being supported by the flexure chute.

17. The method of claim 15, the pressing member being formed of a compressible foam material.

* * * * *